US006272834B1

(12) United States Patent
Barauke

(10) Patent No.: US 6,272,834 B1
(45) Date of Patent: Aug. 14, 2001

(54) APPARATUS FOR CONDENSING A DRAFTED FIBER STRAND

(75) Inventor: Norbert Barauke, Donzdorf (DE)

(73) Assignee: Spindelfabrik Süssen, Schurr, Stahlecker & Grill GmbH, Süssen (DE)

( * ) Notice: Subject to any disclaimer, the term of this patent is extended or adjusted under 35 U.S.C. 154(b) by 0 days.

(21) Appl. No.: 09/570,384

(22) Filed: May 12, 2000

(30) Foreign Application Priority Data

May 12, 1999 (DE) ..... 199 21 966

(51) Int. Cl.[7] ..... D01H 5/28

(52) U.S. Cl. ..... 57/315; 57/304; 57/328; 19/244; 19/246

(58) Field of Search ..... 19/150, 236–250, 19/252, 263, 286, 287, 288, 304–308; 57/315, 304, 328

(56) References Cited

U.S. PATENT DOCUMENTS

| | | | | |
|---|---|---|---|---|
| 5,085,046 | * | 2/1992 | Fehrer | 57/315 |
| 5,157,911 | * | 10/1992 | Stahlecker et al. | 57/315 |
| 5,600,872 | * | 2/1997 | Artzt et al. | 19/244 |
| 6,158,091 | * | 12/2000 | Olbrich et al. | 19/236 |

* cited by examiner

*Primary Examiner*—John J. Calvert
*Assistant Examiner*—Gary L. Welch
(74) *Attorney, Agent, or Firm*—Crowell & Moring, L.L.P.

(57) ABSTRACT

A condensing zone is arranged downstream of the drafting apparatus of a ring spinning machine, through which condensing zone an air permeable transport belt transports the drafted fiber strand. A cleaning element is arranged at the transporting element, which cleaning element takes the form of, for example, a cleaning roller, and which is pressed using a light pressure onto the transporting belt. The rotation direction of the cleaning roller preferably runs in the opposite direction to the direction of motion of the transport belt. The driven bottom roller of the front roller pair of the drafting apparatus can serve as a cleaning roller.

30 Claims, 2 Drawing Sheets

APPARATUS FOR CONDENSING A DRAFTED FIBER STRAND

BACKGROUND AND SUMMARY OF THE INVENTION

This application claims the priority of German Patent Application 199 219 66.4, filed May 12, 1999, the disclosure of which is expressly incorporated by reference herein.

The present invention relates to an apparatus for condensing a drafted fiber strand in a condensing zone arranged downstream of a front roller pair of a drafting apparatus, comprising a stationary sliding surface, which comprises a suction slit extending essentially in transport direction of the fiber strand, also comprising an air-permeable transport belt located between the fiber strand and the sliding surface, which transport belt transports the fiber strand over the sliding surface.

An apparatus of this type is prior art in, for example, U.S. Pat. No. 5,600,872. During operation, there is a risk that individual fibers of the fiber strand for condensing, in particular the shorter fibers, may reach through the perforations of the transport belt with their front ends to the inside. If the fibers are not suctioned off by means of the suction slit, they are transported further with the transport belt and can, in time, clog the perforations, so that the desired condensing effect no longer occurs.

Condensing of a drafted fiber strand, namely in an area to which the spinning twist is not retroactive, serves to bundle the fiber strand in its cross section and to make it generally less hairy. After the spinning twist has been imparted, a smoother yarn with higher tear-resistance is the result. If, however, due to an impaired condensing effect, the desired condensing does not take place, a so-called Moire effect can occur in the finished fabric, which may render the product a reject. It must therefore be ensured that the condensing effect is not impaired by the clogging of perforations at individual spinning stations.

It is an object of the present invention to ensure that the perforations of the transport belt do not become clogged and that the condensing effect is not impaired.

This object has been achieved in accordance with the present invention in that at a distance from the suction slit, a cleaning element is pressed onto the transport belt using a light pressure.

In the simplest embodiment of the present invention, the cleaning element can, for example, be a stationary scraper-like component, which removes the remaining fibers adhering to the outside of the transport belt. However, an even more suitable cleaning element has proven to be a rotating roller, which can basically be applied anywhere outside of the condensing zone at the periphery of the transport belt. It is hereby important that the speeds of the rotating roller and the transport belt differ from one another, preferably in that the peripheral speeds of the transport belt and of the roller are set in opposite directions. This is the case, for example, when the driven bottom roller of the front roller pair of the drating apparatus is chosen as the cleaning element, as then the directions of motion are automatically set in opposite directions.

The sliding surface advantageously comprises a recess in the area of the cleaning element. This facilitates the cleaning of the transport belt, in particular when a suction device is arranged to the cleaning element and/or the recess.

The cleaning effect can be increased when the rotating roller is provided with a profiling on its peripheral surface.

These and further objects, features and advantages of the present invention will become more readily apparent from the following detailed description thereof when taken in conjunction with the accompanying drawings.

DETAILED DESCRIPTION OF THE DRAWINGS

Figure 1:
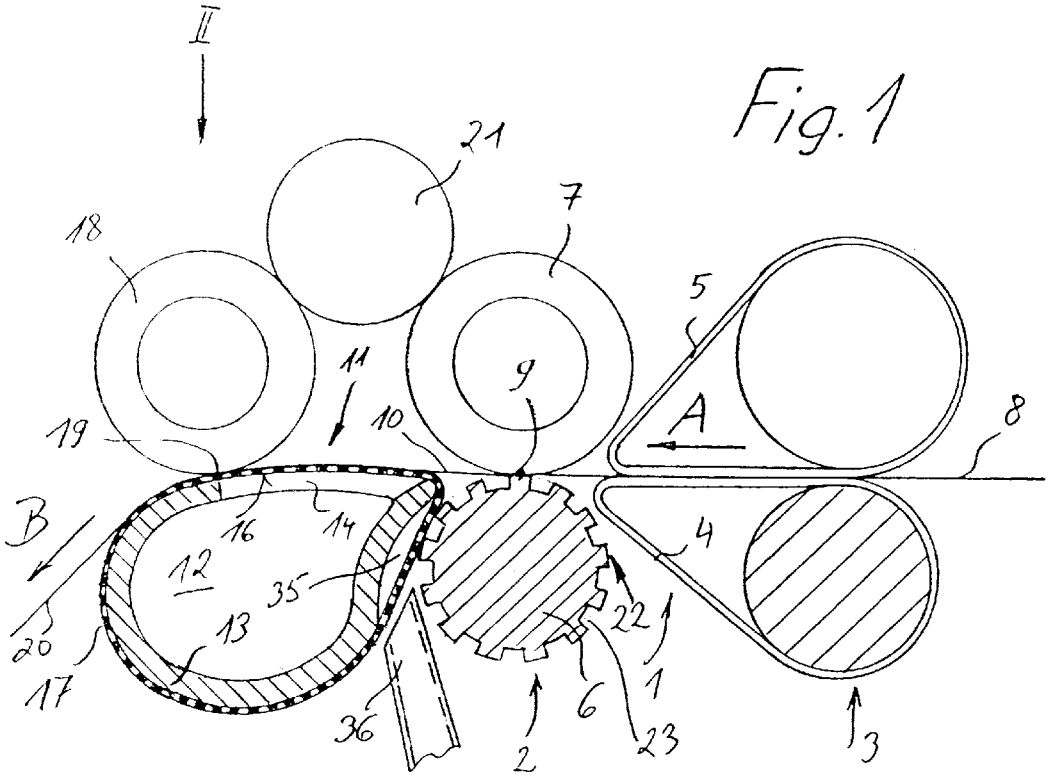
FIG. 1 is a part intersectional side view onto an apparatus of the present invention.
Figure 2:
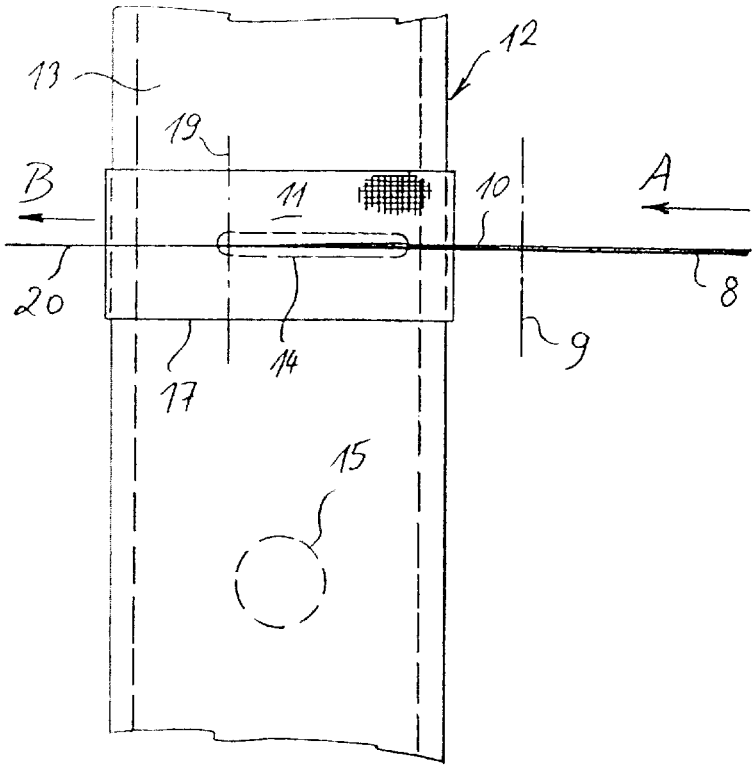
FIG. 2 is a view of the direction of the arrow II of FIG. 1 onto the condensing zone, whereby the other components have been omitted.

In the apparatus according to the FIGS. 1 and 2, only the front roller pair 2 of a drafting apparatus 1 and the apron roller pair 3 arranged upstream thereof are shown, whereby a bottom apron 4 and an upper apron 5 can be seen. The front roller pair 2 comprises a driven bottom roller 6 as well as an upper roller 7 flexibly pressed thereto.

The drafting apparatus 1 serves in a known way to draft a sliver or roving, denoted by the reference number 8, which is transported in transport direction A through the drafting apparatus 1. At the front nipping line 9 of the front roller pair 2, a drafted fiber strand 10 is present, which in this area is still twist-free.

A condensing zone 11 is arranged downstream of the front roller pair 2, in which the drafted fiber strand 10 is bundled in a way described above. The condensing zone 11 comprises a suction device 12, which is essentially formed by a hollow profiling 13 extending over a plurality of spinning stations. On the side facing the condensing zone 11, the hollow profiling 13 comprises per spinning station one suction slit 14, which extends essentially in transport direction and which is significantly wider than the drafted fiber strand 10. The hollow profiling 13 is provided per machine section of a plurality of spinning stations with a vacuum connection 15.

On its side facing the condensing zone 11, the outer contour of the hollow profiling 13 is a stationary sliding surface 16 for a rotating air-permeable transport belt 17. This is driven by a nipping roller 18, which in turn receives its drive from the upper roller 7 of the drafting apparatus 1 by means of a transfer roller 21. The nipping roller 18 forms, together with the stationary sliding surface 16, a delivery nipping line 19, downstream of which the spinning twist is introduced into the thread 20. The thread 20 is hereby fed in delivery direction B to a ring spindle (not shown).

Beginning at the suction slit 14 in the condensing zone 11, there is a risk that individual fiber ends may get through the perforations of the transport belt 17 and remain caught in the transport belt 17. These remaining fibers must be removed from the transport belt 17 so that the transport belt 17 does not, in time, become air-impermeable.

A cleaning element 22 is provided for the continuous cleaning of the rotating transport belt 17, which in this embodiment of the present invention is the driven bottom roller 6, which is disposed with a light pressure on the transport belt 17. At the point of contact, the directions of motion of the transport belt 17 and the bottom roller 6 are set in opposite directions, so that the cleaning effect is particularly intensive. Any remaining fibers caught in the perforations are reliably removed. Here a profiling 23 co-acts with the cleaning element, which profiling 23 is applied to the periphery of the driven bottom roller 6 and which can be in the form of, for example, longitudinal grooves, diagonal knurling or a grooving.

The cleaning effect can be further improved when the sliding surface 16 comprises a recess 35 in the area of the cleaning element 22, so that the transport belt 17 can yield a little at this point. Fiber fly, or the like, removed by the cleaning element 22 is then removed by an additional suction device 36.

Figure 3:
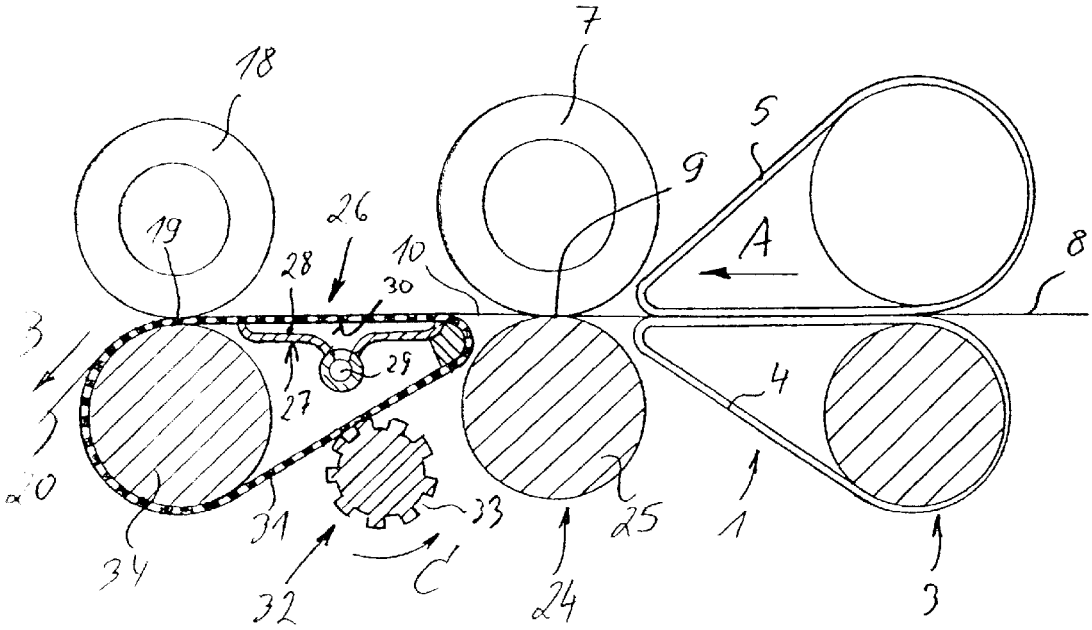
FIG. 3 is a view similar to FIG. 1 of another embodiment of the present invention.

In another embodiment of the apparatus of the present invention as shown in FIG. 3, the reference numbers are retained insofar as they correspond to those in FIGS. 1 and 2. A repeat description is therefore omitted.

In the embodiment of the present invention according to FIG. 3, a standard driven bottom roller 25 for drafting apparatus 1 is provided, which does not need to be provided with a profiling. The front roller pair 24 is formed by the bottom roller 25 and the top roller 7 arranged thereto. A condensing zone 26 is arranged downstream of the front nipping line 9, which condensing zone 26 is designed differently from the variation described above.

The condensing zone 26 as shown in FIG. 3 comprises a suction device 27, which is directed with a suction slit 28 against a rotating transport belt 31. The suction device 27 is connected to a vacuum source (not shown) by means of a vacuum connection 29. The suction device 27 comprises again a stationary sliding surface 30, over which the air-permeable transport belt 31 slides. In this embodiment of the present invention, the transport belt 31 is looped around a separate driven delivery roller 34, which in turn drives the transport belt 31 and forms, together with a nipping roller 18, the delivery nipping line 19.

A cleaning element 32, in the form of a roller rotating in direction C, is arranged at the transport belt 31 on the side facing away from the suction slit 28. This roller is provided with a profiling 33 and is disposed, using a light pressure, on the transport belt 31, so that the transport belt 31 is reliably freed from adhering fibers.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus for condensing a drafted fiber strand in a condensing zone arranged downstream of a front roller pair of a drafting apparatus, comprising, a stationary sliding surface which includes a suction slit extending essentially in transport direction of the fiber strand, an air-permeable transport belt located between the fiber strand and the sliding surface, which transport belt transports the fiber strand over the sliding surface, and a cleaning element separate from the suction slit and pressed in use against the transport belt at a location spaced from the suction slit.

2. An apparatus according to claim 1, wherein the cleaning element takes the form of a rotating roller.

3. An apparatus according to claim 2, wherein the peripheral speeds of the transport belt and the roller are set in opposite directions to one another.

4. An apparatus according to claim 3, wherein the roller is provided on its peripheral surface with a profiling.

5. An apparatus according to claim 4, wherein the roller is a driven bottom roller of the front roller pair.

6. An apparatus according to claim 3, wherein the roller is a driven bottom roller of the front roller pair.

7. An apparatus according to claim 6, wherein the sliding surface comprises a recess in the area of the cleaning element.

8. An apparatus according to claim 7, wherein a suction device is disposed to face the recess and is operable to form a suction air flow from the recess through the air permeable transport belt to aid in cleaning the transport belt.

9. An apparatus according to claim 8, wherein the suction device is disposed upstream of the cleaning element in a transport direction of the transport belt.

10. An apparatus according to claim 3, wherein the sliding surface comprises a recess in the area of the cleaning element.

11. An apparatus according to claim 10, wherein a suction device is arranged at the recess.

12. An apparatus according to claim 11, wherein said suction device is disposed to face the recess and is operable to form a suction air flow from the recess through the air permeable transport belt to aid in cleaning the transport belt.

13. An apparatus according to claim 12, therein the suction device is disposed upstream of the cleaning element in a transport direction of the transport belt.

14. An apparatus according to claim 2, wherein the roller is provided on its peripheral surface with a profiling.

15. An apparatus according to claim 14, wherein the roller is a driven bottom roller of the front roller pair.

16. An apparatus according to claim 14, wherein the sliding surface comprises a recess in the area of the cleaning element.

17. An apparatus according to claim 10, wherein a suction device is arranged at the recess.

18. An apparatus according to claim 17, wherein said suction device is disposed to face the recess and is operable to form a suction air flow from the recess through the air permeable transport belt to aid in cleaning the transport belt.

19. An apparatus according to claim 18, wherein the suction device is disposed upstream of the cleaning element in a transport direction of the transport belt.

20. An apparatus according to claim 19, wherein the sliding surface comprises a recess in the area of the cleaning element.

21. An apparatus according to claim 20, wherein a suction device is disposed to face the recess and is operable to form a suction air flow from the recess through the air permeable transport belt to aid in cleaning the transport belt.

22. An apparatus according to claim 21, wherein the suction device is disposed upstream of the cleaning element in a transport direction of the transport belt.

23. An apparatus according to claim 2, wherein the sliding surface comprises a recess in the area of the cleaning element.

24. An apparatus according to claim 23, wherein a suction device is arranged at the recess.

25. An apparatus according to claim 24, wherein said suction device is disposed to face the recess and is operable to form a suction air flow from the recess through the air permeable transport belt to aid in cleaning the transport belt.

26. An apparatus according to claim 25, wherein the suction device is disposed upstream of the cleaning element in a transport direction of the transport belt.

27. An apparatus according to claim 1, wherein the sliding surface comprises a recess in the area of the cleaning element.

28. An apparatus according to claim 27, wherein a suction device is arranged at the recess.

29. An apparatus according to claim 28, wherein said suction device is disposed to face the recess and is operable to form a suction air flow from the recess through the air permeable transport belt to aid in cleaning the transport belt.

30. An apparatus for condensing a drafted fiber strand in a condensing zone arranged downstream of a front roller pair of a drafting apparatus, comprising, a stationary sliding surface which includes a suction slit extending essentially in transport direction of the fiber strand, an air-permeable transport belt located between the fiber strand and the sliding surface, which transport belt transports the fiber strand over the sliding surface, and a cleaning element pressed in use against the transport belt at a location spaced from the suction slit, wherein the cleaning element takes the form of a rotating roller, wherein the peripheral speeds of the transport belt and the roller are set in opposite directions to one another, and wherein the roller is a driven bottom roller of the front roller pair.

* * * * *